US009393174B1

(12) United States Patent
Pope

(10) Patent No.: US 9,393,174 B1
(45) Date of Patent: Jul. 19, 2016

(54) EXTENSIBLE VIBRATING SHOWER APPARATUS

(76) Inventor: Carl C. Pope, Claremont, NC (US)

( * ) Notice: Subject to any disclaimer, the term of this patent is extended or adjusted under 35 U.S.C. 154(b) by 1016 days.

(21) Appl. No.: 13/484,525

(22) Filed: May 31, 2012

(51) Int. Cl.

| | |
|---|---|
| ***A61H 9/00*** | (2006.01) |
| ***A47L 13/22*** | (2006.01) |
| ***A47K 7/02*** | (2006.01) |
| ***B05B 1/18*** | (2006.01) |
| ***B05B 1/14*** | (2006.01) |
| ***B05B 9/01*** | (2006.01) |
| ***A61H 23/04*** | (2006.01) |
| ***A47K 3/00*** | (2006.01) |

(52) U.S. Cl.
CPC .. *A61H 9/00* (2013.01); *A47K 7/02* (2013.01); *A47L 13/22* (2013.01); *A61H 23/04* (2013.01)

(58) Field of Classification Search
CPC ..... A47K 7/02; B05B 15/08; B05B 9/08; B05B 1/18; A61H 15/00; A46B 11/06; A46B 11/063; A46B 11/066
USPC ..... 239/587.1–587.5, 588, 600, 146, 166, 239/443–449, 309–394, 530, 280, 281; 4/606; 285/146, 144, 166
See application file for complete search history.

(56) References Cited

U.S. PATENT DOCUMENTS

| | | | | |
|---|---|---|---|---|
| 3,720,204 | A | 3/1973 | Wojtowicz | |
| 4,841,590 | A | 6/1989 | Terry et al. | |
| 5,722,570 | A * | 3/1998 | Sultzer, III | B65D 47/063 222/529 |
| 6,021,539 | A | 2/2000 | Zhadanov et al. | |
| 6,151,728 | A * | 11/2000 | Wright | A47K 7/046 4/606 |
| 6,629,651 | B1 * | 10/2003 | Male | B05B 15/066 239/587.1 |
| 6,915,541 | B2 | 7/2005 | Alexander | |
| 7,320,667 | B1 * | 1/2008 | Hanna | A61H 7/001 601/46 |
| 7,770,822 | B2 * | 8/2010 | Leber | B05B 15/061 239/280 |
| 8,439,588 | B2 * | 5/2013 | Houman | A46B 13/06 15/29 |
| 8,652,078 | B2 * | 2/2014 | Lee | B05B 1/083 239/102.1 |
| 8,695,132 | B2 * | 4/2014 | Wu | B05B 1/18 4/606 |
| 2010/0083438 | A1 * | 4/2010 | Kao | A46B 11/063 4/606 |

FOREIGN PATENT DOCUMENTS

| | | | | |
|---|---|---|---|---|
| EP | 1616548 | B1 * | 5/2008 | |
| IT | EP 1616548 | A1 * | 1/2006 | A61H 15/0085 |

* cited by examiner

*Primary Examiner* — Mark A Laurenzi
*Assistant Examiner* — Thomas M Abebe
(74) *Attorney, Agent, or Firm* — Crossley & Stevenson Intellectual Property Law

(57) ABSTRACT

An extensible vibrating shower apparatus that includes a shower member retractably extensible from within an ergonomically formed handle, said shower member including a generally tubular neck, a flexible joint disposed endwise upon the neck, and a head disposed upon the flexible joint, the head having a nozzle with a plurality of bristle holes disposed in a radial pattern and a plurality of massage pads disposed thereon, through which plurality of bristle holes a plurality of bristles is retracably extensible from within the head when a rotatable rim is turned, and a water proof switch alternately activates and deactivates a vibrator disposed within the head, which vibrator is in operational communication with the plurality of massage pads.

4 Claims, 3 Drawing Sheets

EXTENSIBLE VIBRATING SHOWER APPARATUS

BACKGROUND OF THE INVENTION

Various types of shower apparatuses are known in the prior art. However, what is needed is an extensible vibrating shower apparatus that includes a shower member retractably extensible from within an ergonomically formed handle, said shower member including a generally tubular neck, a flexible joint disposed endwise upon the neck, and a head disposed upon the flexible joint, the head having a nozzle with a plurality of bristle holes disposed in a radial pattern and a plurality of massage pads disposed thereon, through which plurality of bristle holes a plurality of bristles is retracably extensible from within the head when a rotatable rim is turned, and a water proof switch alternately activates and deactivates a vibrator disposed within the head, which vibrator is in operational communication with the plurality of massage pads.

FIELD OF THE INVENTION

The present invention relates to an extensible vibrating shower apparatus, and more particularly, to an extensible vibrating shower apparatus that includes a shower member retractably extensible from within an ergonomically formed handle, said shower member including a generally tubular neck, a flexible joint disposed endwise upon the neck, and a head disposed upon the flexible joint, the head having a nozzle with a plurality of bristle holes disposed in a radial pattern and a plurality of massage pads disposed thereon, through which plurality of bristle holes a plurality of bristles is retracably extensible from within the head when a rotatable rim is turned, and a water proof switch alternately activates and deactivates a vibrator disposed within the head, which vibrator is in operational communication with the plurality of massage pads.

SUMMARY OF THE INVENTION

The general purpose of the extensible vibrating shower apparatus, described subsequently in greater detail, is to provide an extensible vibrating shower apparatus which has many novel features that result in an extensible vibrating shower apparatus which is not anticipated, rendered obvious, suggested, or even implied by prior art, either alone or in combination thereof.

Many showering apparatuses are seen in the prior art. But what is needed is an extensible vibrating shower apparatus that enables a person to soothingly wash themselves while showering. The present extensible vibrating shower apparatus is envisioned to be fitted in a typical shower to replace an extant shower nozzle, thereby enabling a person showering the added benefits and enjoyment of using the present device.

The instant extensible vibrating shower apparatus includes an ergonomically formed handle attached to a hose. The hose provides a range of motion to the extensible vibrating shower apparatus, enabling close contact with the body, as desired. The extensible vibrating shower apparatus is also useable as a normal shower, when the extensible vibrating shower apparatus is positioned above the body from an extant shower bracket, as desired.

A shower member is retractably extensible from within the handle. The shower member includes a generally tubular neck, a flexible joint disposed endwise upon the neck, and a head disposed upon the flexible joint. A nozzle is disposed on the head, and a plurality of bristle holes is disposed in a radial pattern upon the nozzle. A plurality of bristles are disposed within the head. The plurality of bristles is retractably extensible from within the head to protrude through the plurality of bristle holes when a rotatable rim is rotated from a first position to a second position. The rotatable rim is perimetrically disposed around the nozzle. These bristles, when extended, assist cleaning and washing by scouring the epidermis when showering.

A vibrator is also disposed within the head. The vibrator is in operational communication with a plurality of massage pads disposed on the nozzle. When a switch, disposed upon the handle, is moved from a first position to a second position the vibrator activates the plurality of massage pads causing them to vibrate. Thusly, the extensible vibrating shower apparatus may be used to massage the body while showering, the extensible neck enabling positioning of the head to contact the body, as desired.

An accordion hose is disposed within the handle and continuously wrought through the neck to the head. The accordion hose forms a continuous cavity when the extensible vibrating shower apparatus is connected to the hose. The accordion hose is articulated and accordions out when the shower member is extended from within the handle. When the shower member is retracted within the handle, the accordion hose folds compressibly to accommodate the neck within the handle. The shower member is lockable at a desired extension from within the handle by means of a rotatable cuff, said cuff continuously disposed around a top surface of the handle.

Thus has been broadly outlined the more important features of the present extensible vibrating shower apparatus so that the detailed description thereof that follows may be better understood and in order that the present contribution to the art may be better appreciated.

Objects of the present extensible vibrating shower apparatus, along with various novel features that characterize the invention are particularly pointed out in the claims forming a part of this disclosure. For better understanding of the extensible vibrating shower apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
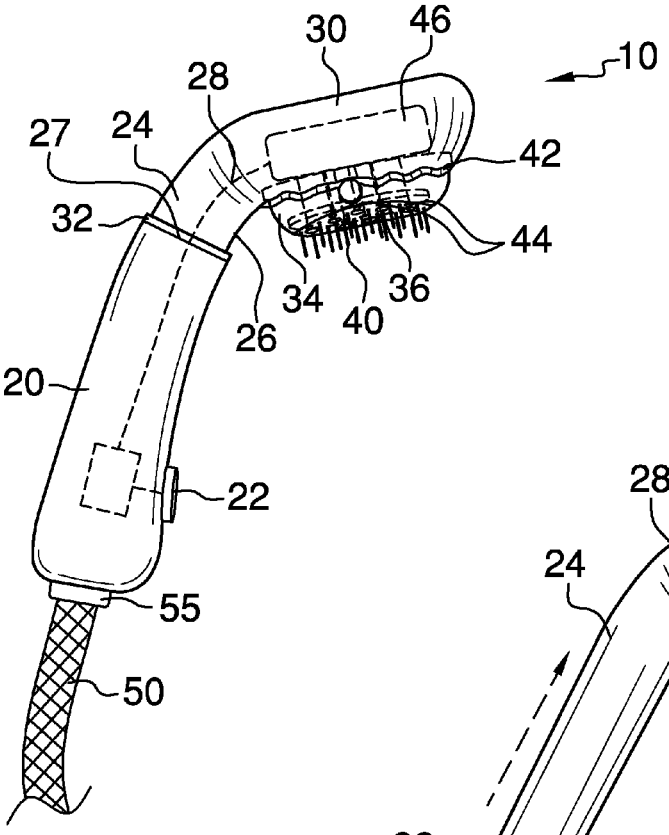
FIG. 1 is a side view.
Figure 2:
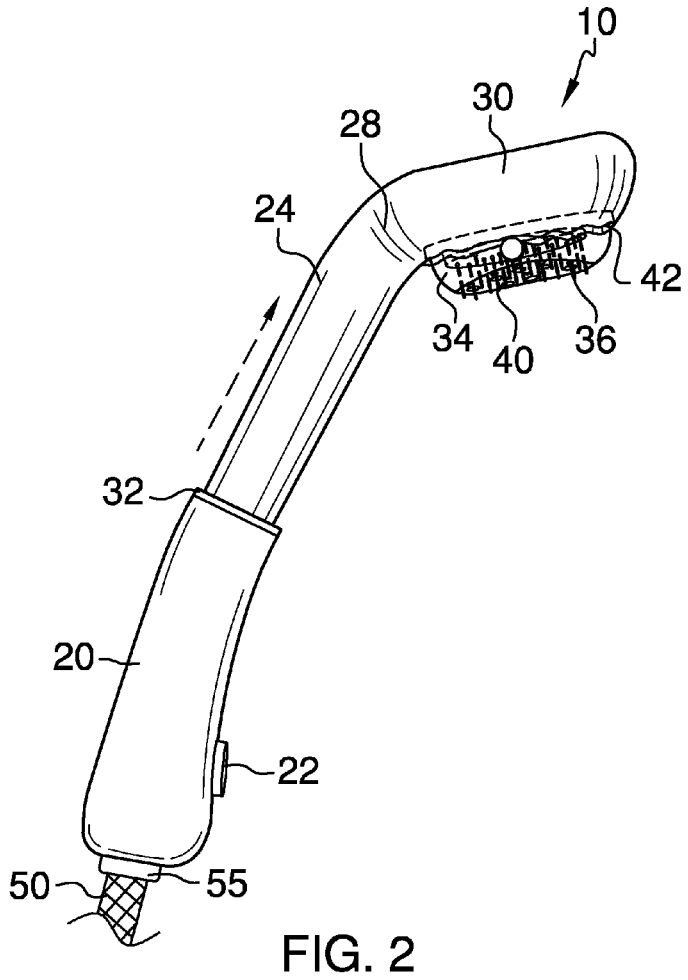
FIG. 2 is a side view with a shower member extended from within a handle.
Figure 3:
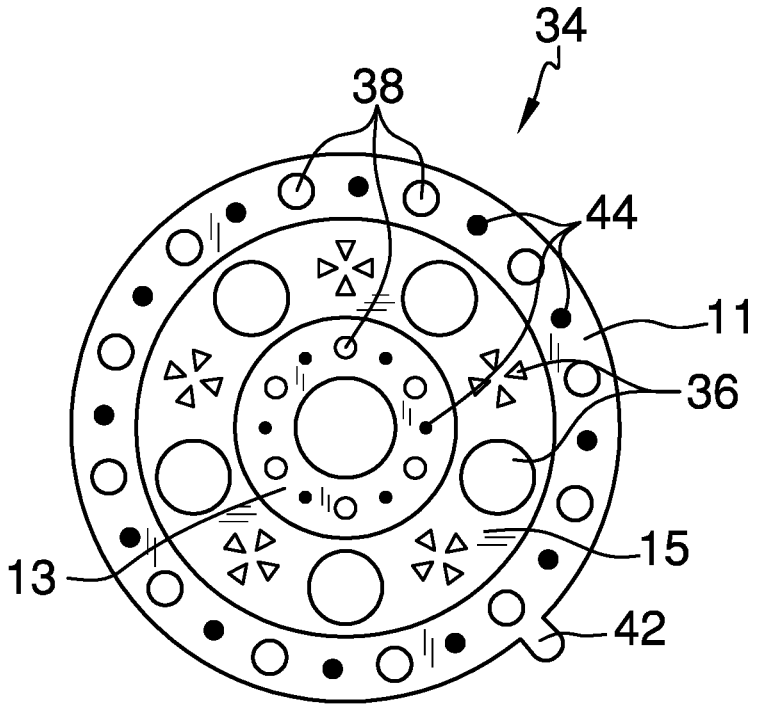
FIG. 3 is a top view of a nozzle.
Figure 4:
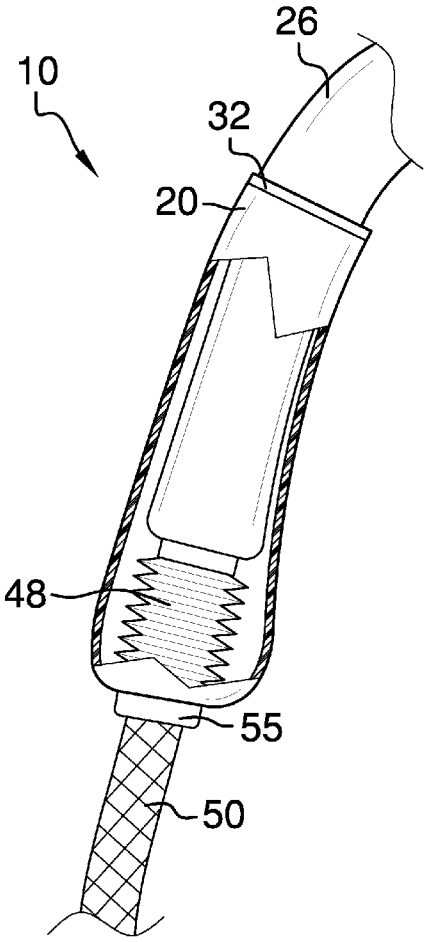
FIG. 4 is a side view with a cutaway section of the handle.
Figure 5:
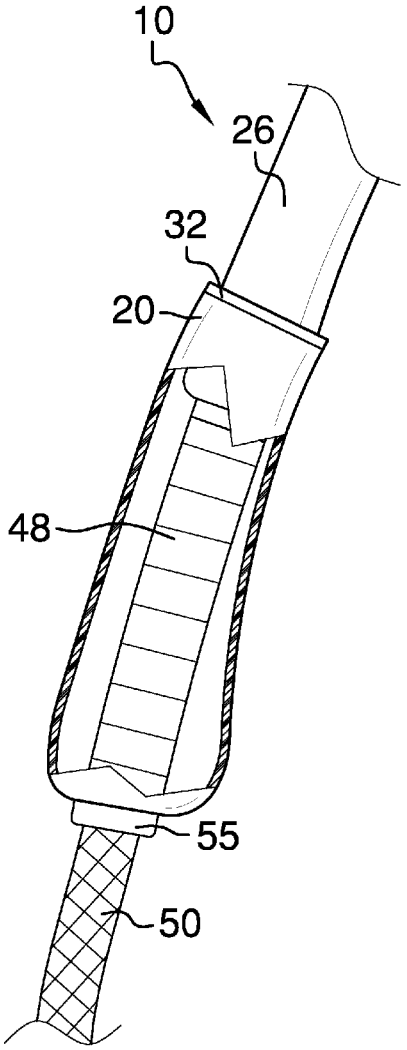
FIG. 5 is a side view with a cutaway section detailing an extension of an accordion hose.

With reference now to the drawings, and in particular FIGS. 1 through 5 thereof, example of the instant extensible vibrating shower apparatus employing the principles and concepts of the present extensible vibrating shower apparatus and generally designated by the reference number 10 will be described.

Referring to FIGS. 1 through 5 a preferred embodiment of the present extensible vibrating shower apparatus 10 is illustrated.

The extensible vibrating shower apparatus 10 includes an ergonomically molded handle 20 with a waterproof switch 22 disposed thereupon. The handle 20 is disposed endwise upon a flexible hose 50, said hose 50 connected to the handle 20 at a connector collar 55. The hose 50 is also connected to a water outlet (not shown), thereby enabling the extensible vibrating shower apparatus 10 to have a range of motion to be used in close contact with the body, as desired.

A shower member is retractably extensible from within the handle 20. The shower member 24 includes a generally tubular neck 26, a flexible joint 28 disposed endwise upon the neck 26, and a head 30 disposed upon the flexible joint 28. The head 30 is directable by means of the flexible joint 28. The shower member 24 is releasably lockable at a desired extension from within the handle 20 by means of a rotatable cuff 32 continuously disposed around a top surface 27 of the handle 20.

A nozzle 34 is disposed upon the head 30. The nozzle 34 has a ring-shaped outer section 11, a ring-shaped inner section 13, and a ring-shaped middle section 15 disposed between the outer section 11 and the inner section 13. A plurality of water holes 36 is disposed in a radial pattern upon the middle section 15 of the nozzle 34. A plurality of bristle holes 38 is disposed in a radial pattern upon the outer section 11 of the nozzle 34 and the inner section 13 of the nozzle 34, the plurality of bristle holes 38 disposed in a series of concentric rings. A plurality of extensible bristles 40 is disposed within the head, each of the plurality of bristles extensible through each of the plurality of bristle holes 38. The plurality of bristles 40 is extensible to protrude out the plurality of bristle holes 38 when a rotatable rim 42, disposed perimetrically around the nozzle 34, is rotated.

A plurality of massage pads 44 is also disposed upon the outer section 11 of the nozzle 34 and the inner section 13 of the nozzle 34. A vibrator 46 is disposed within the head 30, the vibrator in operational communication with each of the plurality of massage pads 44. The vibrator is alternately activated and deactivated when the switch 22 is moved between a first position and a second position.

An accordion hose 48 is disposed within the handle 20, the accordion hose 48 connected to the neck 26. The accordion hose 48 accordions out when the shower member 24 is extended from the handle 20 and the accordion hose 48 is compressible when the shower member 24 is retracted. The accordion hose 48 connects to the hose 50 when the handle 20 is releasably attached to the hose 50 by means of the connector collar 55.

The shower member 24 is therefore retractably extensible from within the handle 20. The bristles 40 are extensible and alternately retractable when the rim 42 is rotated, and the vibrator 46 is activated and deactivated when the switch 22 is moved between a first position and a second position.

What is claimed is:

1. An extensible vibrating shower apparatus comprising:
an ergonomically molded handle;
a waterproof switch disposed on the handle;
a shower member extensible from within the handle, the shower member comprising:
a generally tubular neck;
a flexible joint disposed endwise on the neck;
a head disposed upon the flexible joint;
a nozzle disposed upon the head, the nozzle having a ring-shaped outer section, a ring-shaped inner section, and a ring-shaped middle section disposed between the outer section and the inner section;
a plurality of water holes disposed in a radial pattern upon the nozzle middle section;
a plurality of bristle holes disposed in a radial pattern upon the nozzle outer section and the nozzle inner section;
a plurality of extensible bristles disposed within the head, the plurality of bristles extensible through the plurality of bristle holes;
a plurality of massage pads disposed upon the nozzle outer section and the nozzle inner section;
a vibrator disposed within the head, the vibrator in operational communication with each of the plurality of massage pads;
a rotatable rim disposed perimetrically around the nozzle;
an accordion hose disposed within the handle, the accordion hose connected to the neck, said hose unfoldable when the shower member is extended from the handle and compressible when the shower member is retracted;
wherein the shower member is releasably extensible from within the handle, the bristles are extensible and alternately retractable when the rim is rotated, and the vibrator is activated and deactivated when the switch is moved between a first position and a second position;
a rotatable cuff continuously disposed around a top surface of the handle;
wherein the shower member is releasably lockable at a desired extension from within the handle by means of the cuff.

2. The extensible vibrating shower apparatus of claim 1 wherein the head further comprises a contact side.

3. The extensible vibrating shower apparatus of claim 2 wherein the nozzle is disposed on the contact side.

4. The extensible vibrating shower apparatus of claim 3 wherein the handle is connectable to a hose by means of a connector collar, said hose connected to an extant shower water outlet.

* * * * *